US007581534B2

(12) United States Patent
Aida et al.

(10) Patent No.: US 7,581,534 B2
(45) Date of Patent: Sep. 1, 2009

(54) INTERNAL COMBUSTION ENGINE IGNITION DEVICE

(75) Inventors: Futoshi Aida, Chiyoda-ku (JP); Yukio Yasuda, Chiyoda-ku (JP); Yusuke Naruse, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/139,110

(22) Filed: Jun. 13, 2008

(65) Prior Publication Data

US 2009/0183719 A1 Jul. 23, 2009

(30) Foreign Application Priority Data

Jan. 22, 2008 (JP) ..... 2008-011684

(51) Int. Cl.
*F02P 11/00* (2006.01)
*F02P 5/145* (2006.01)

(52) U.S. Cl. ..... 123/644; 123/406.11; 123/619; 701/102; 701/114

(58) Field of Classification Search ..... 123/605, 123/618, 619, 630, 644, 650–652, 406.11–406.14, 123/406.27, 406.56; 73/114.14; 701/102, 701/105, 114
See application file for complete search history.

(56) References Cited

U.S. PATENT DOCUMENTS

| | | | | |
|---|---|---|---|---|
| 6,814,066 | B2 * | 11/2004 | Ando | 123/644 |
| 6,998,846 | B2 * | 2/2006 | Daniels et al. | 324/399 |
| 7,055,372 | B2 * | 6/2006 | Daniels et al. | 73/35.08 |
| 7,063,079 | B2 * | 6/2006 | Huberts et al. | 123/630 |
| 7,086,382 | B2 * | 8/2006 | Daniels et al. | 123/406.23 |
| 7,137,385 | B2 * | 11/2006 | Newton | 123/630 |
| 7,197,913 | B2 * | 4/2007 | Zhu et al. | 73/35.08 |
| 2004/0084021 | A1 | 5/2004 | Zhu et al. | |
| 2007/0267004 | A1 * | 11/2007 | Yamauchi | 123/604 |

FOREIGN PATENT DOCUMENTS

JP 2004-156608 A 6/2004

* cited by examiner

*Primary Examiner*—Stephen K. Cronin
*Assistant Examiner*—Johnny H. Hoang
(74) *Attorney, Agent, or Firm*—Sughrue Mion, PLLC

(57) ABSTRACT

An internal combustion engine ignition device is provided in which an ECU (200) includes a pulse generation circuit (201) that outputs pulse signals (Igt1 and Igt2) and an ion-signal detection/control circuit (300), and a coil driver (400) includes a pulse detection circuit (7) that recognizes a signal received from the pulse generation circuit (201) and an ion-current detection circuit (9); when the pulse signals are not outputted, an ion current is detected and a signal is outputted at the same line as a coil-driver input signal line.

7 Claims, 13 Drawing Sheets

INTERNAL COMBUSTION ENGINE IGNITION DEVICE

BACKGROUND OF THE INVENTION

1. Field of the Invention

The present invention relates to an internal combustion engine ignition device, for example, mounted on a vehicle, and particularly to an internal combustion engine ignition device that generates an ignition high voltage across the secondary coil of an ignition coil, by flowing and interrupting an electric current for the primary coil of the ignition coil by use of a switching element.

2. Description of the Related Art

In a conventional internal combustion engine ignition device, an ion signal and an ignition signal are multiplexed and outputted on a coil-driver input signal line, and in the case where the ion signal is outputted, masking is performed so that the switching element does not turn on (for example, refer to Japanese Patent Laid-Open Pub. No. 2004-156608, Pages 17 and 18, FIGS. 49 and 50).

In the conventional internal combustion engine ignition device, there has been a problem that, in the case where, when the ion signal and the ignition signal are outputted at the coil-driver input signal line, the inside of the engine compartment becomes high-temperature, thereby causing pre-ignition, or a smolder occurs around the ignition plug, thereby producing soot between the electrodes, causing a leakage electric current to flow, and causing a pseudo ion current to flow constantly, it is required that the dynamic range of the input voltage be set wide in order to detect the ion current even at the timing when the ignition signal is supplied; as a result, the circuit scale of the ECU (Electronic Control Unit) becomes large, thereby causing the cost hike.

Moreover, there has been a problem that, in the case where a certain factor such as interruption of the primary-coil current causes a difference between the ground potential for the ECU and the ground potential for the coil driver, the ion signal cannot accurately be transferred to the ECU.

SUMMARY OF THE INVENTION

The present invention has been implemented in order to solve the foregoing problems; the objective of the present invention is to provide an internal combustion engine ignition device that can securely detect the ion current even at the timing when the ignition signal is supplied and that improves the functionality of the ignition system by enlarging at low cost the region in which the ion current can be detected.

An internal combustion engine ignition device according to the present invention includes an ignition coil having a primary coil and a secondary coil and a switching element that generates an ignition high voltage across the secondary coil of the ignition coil by flowing and interrupting a primary-coil current of the ignition coil; the internal combustion engine ignition device further includes an ECU (electronic control unit) including a pulse generation circuit that supplies a coil-driver input signal line with a single pulse signal having an extremely short duration or a plurality of pulse signals, as an energization start signal Igt1 or a de-energization signal Igt2; a pulse detection circuit that stores the energization start signal and the de-energization signal, that recognizes the single pulse signal or the plurality of pulse signals, received by way of the coil-driver input signal line from the pulse generation circuit, as the energization start signal or the de-energization signal, and that supplies an ignition signal to the switching element; an ion bias circuit that is connected to a low-voltage side of the secondary coil and generates an ion current; an ion-current detection circuit that detects an ion current flowing through the secondary coil; an ion-current output circuit that outputs an ion signal at the coil-driver input signal line, based on an output signal of the ion-current detection circuit; and an ion-signal detection/control circuit that is included in the ECU and that detects and controls an output signal of the ion-current output circuit. The internal combustion engine ignition device is configured in such a way that, at a timing when the pulse generation circuit outputs neither the energization start signal nor the de-energization signal, the ion-signal detection/control circuit sets an input voltage Igt of a coil driver to a high level, and at a timing when the pulse generation circuit outputs the energization start signal or the de-energization signal, the input voltage Igt of the coil driver is lowered for an extremely short time from the high level to a low level, so that the pulse detection circuit recognizes the change in the input voltage Igt as the energization start signal or the de-energization signal and supplies an ignition signal to the switching element, and in such a way that, at a timing except the timing when the energization start signal and the de-energization signal is supplied to the pulse detection circuit, the ion-current output circuit outputs an ion signal at the coil-driver input signal line, based on an ion current detected by the ion-current detection circuit.

According to the present invention, an internal combustion engine ignition device can be obtained in which, even in the case where the ignition signal is supplied when, the inside of the engine compartment becomes high-temperature, thereby causing pre-ignition, or a smolder around the ignition plug causes soot or the like in the space between the electrodes, thereby causing a leakage electric current to flow, whereby a pseudo ion current always flows, it is not required to make the dynamic range of the input voltage Igt wide, an ion current can accurately be detected by a 5-Volt system, and, at low cost, an ion-current detection region is enlarged and the functionality of the ignition system is enhanced.

Moreover, at the timing when the pulse generation circuit outputs neither the energization start signal nor the de-energization signal, the input voltage Igt of the coil driver is set to a high level (from 5 V to 14 V), so that the ion signal can accurately be transferred to the ECU, even in the case where a difference between the ground potential for the ECU and the ground potential for the coil driver is caused, for example, at the timing of interruption of the primary-coil current.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiments of the present invention will be explained below with reference to the accompanying drawings.

Embodiment 1

Figure 1:
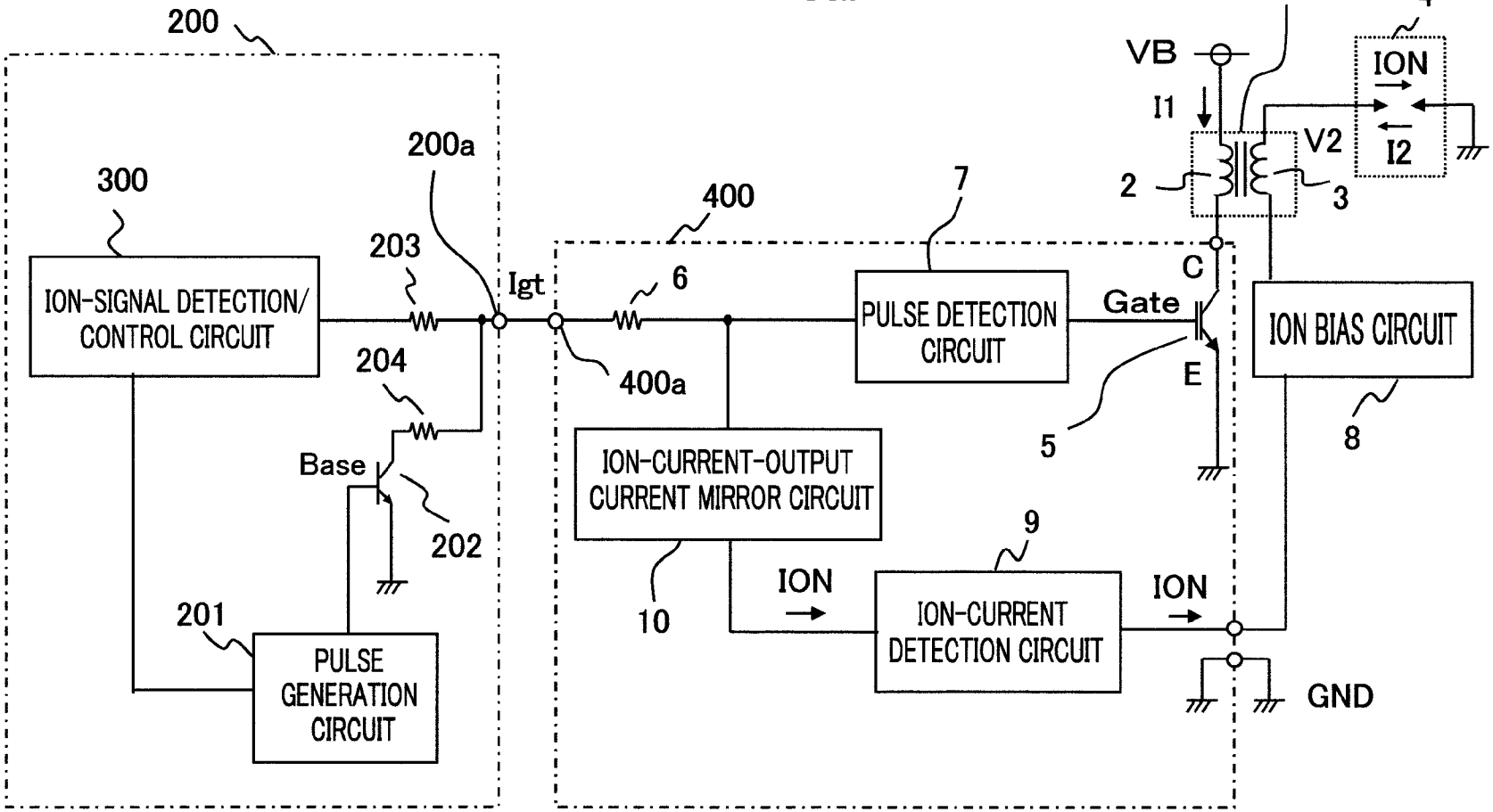
FIG. 1 is a schematic block diagram illustrating principal parts of an internal combustion engine ignition device according to Embodiment 1 of the present invention.
Figure 2:
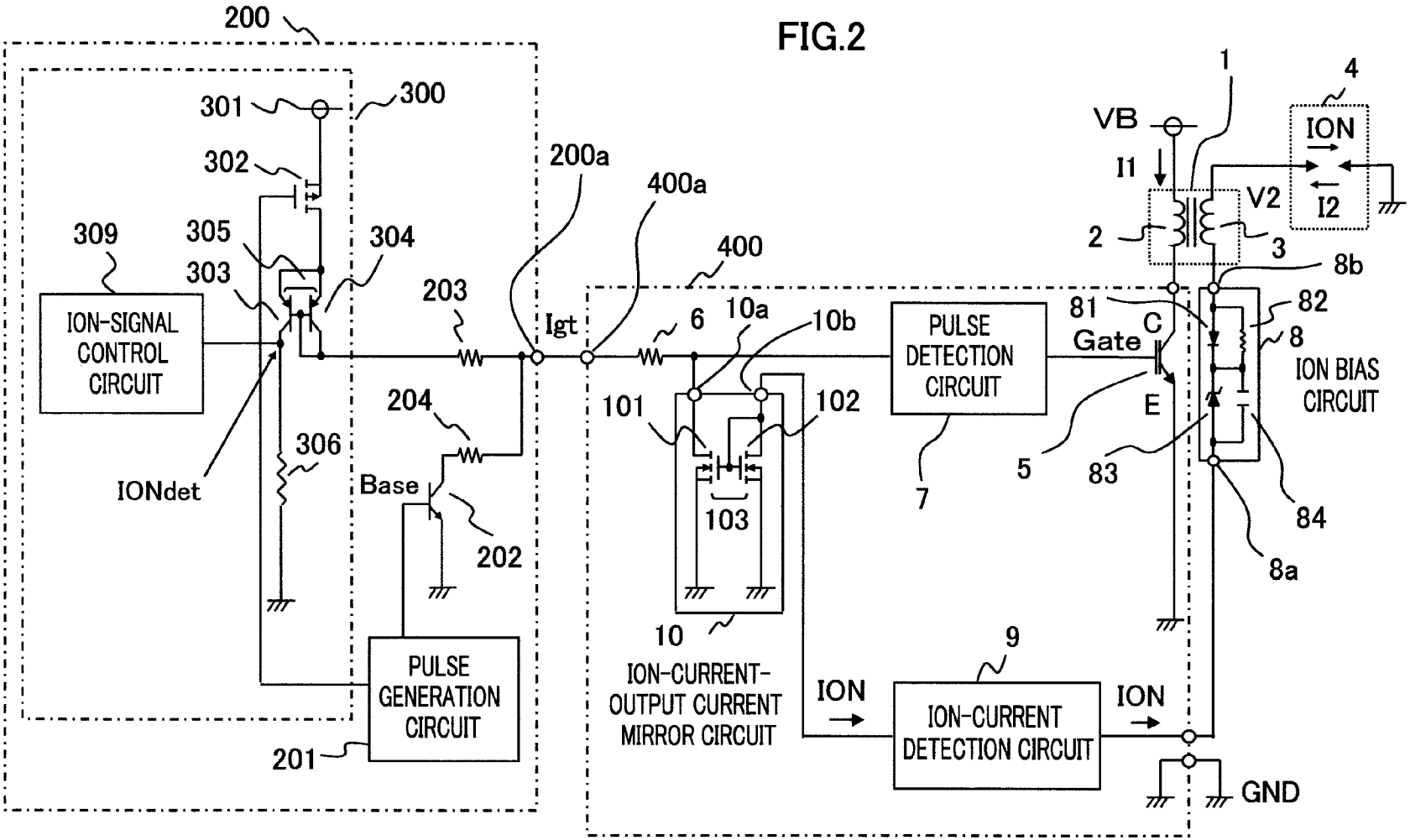
FIG. 2 is a detailed circuit diagram of an internal combustion engine ignition device according to Embodiment 1 of the present invention.

FIGS. 1 and 2 are circuit block diagrams illustrating an internal combustion engine ignition device according to Embodiment 1 of the present invention; FIG. 1 is a schematic block diagram illustrating principal parts of Embodiment 1; FIG. 2 is a detailed circuit diagram for the principal parts illustrated in FIG. 1. In the first place, the principal parts of Embodiment 1 of the present invention will be explained with reference to FIG. 1.

As illustrated in FIG. 1, the internal combustion engine ignition device according to Embodiment 1 of the present invention is provided with an ignition coil 1 having a primary coil 2 and a secondary coil 3, a pulse generation circuit 201 that is incorporated in an electronic control unit (hereinafter, referred to also as ECU) 200 and outputs an energization start signal Igt1 and a de-energization signal Igt2, and an NPN transistor 202 that supplies the later stage with a signal, based on the energization start signal Igt1 and the de-energization signal Igt2 that are outputted by the pulse generation circuit 201. In addition, the foregoing internal combustion engine ignition device is provided with a pulse detection circuit 7 that stores the energization start signal Igt1 and the de-energization signal Igt2, recognizes a signal, supplied from the collector of the NPN transistor 202 to the pulse detection circuit 7 by way of a resistor 204 and an input impedance 6 inside a coil driver 400, as the energization start signal Igt1 or the de-energization signal Igt2, and supplies the later stage with an ignition signal; a switching element 5 that, based on the output signal of the pulse detection circuit 7, flows and interrupts a primary-coil current I1 for the primary coil 2 of the ignition coil so as to generate a high voltage, for igniting an ignition plug 4, across the secondary coil 3 of the ignition coil 1; an ion bias circuit 8 for generating an ion current, which is connected to the low-voltage side of the secondary coil 3; an ion-current detection circuit 9 that detects an ion current generated after the execution of ignition and outputs the ion current to the later stage; an ion-current-output current mirror circuit 10 that outputs an ion current, based on the output signal of the ion-current detection circuit 9; and an ion-signal detection/control circuit 300 that detects and controls the output signal of the ion-current-output current mirror circuit 10.

The internal combustion engine ignition device is configured in such a way that, at the timing when the pulse generation circuit 201 outputs neither the energization start signal Igt1 nor the de-energization signal Igt2, the ion-signal detection/control circuit 300 inside the ECU sets an input voltage Igt of the coil driver 400 to a high level (from 5 V to 14 V), and at the timing when the pulse generation circuit 201 outputs the energization start signal Igt1 or the de-energization signal Igt2, the ion-signal detection/control circuit 300 lowers for an extremely short time the input voltage Igt of the coil driver 400 from the high level (from 5 V to 14 V) to a low level (0 V), so that the pulse detection circuit 7 recognizes the change in the input voltage Igt as the energization start signal Igt1 or the de-energization signal Igt2 and supplies an ignition signal to the switching element 5, thereby driving the switching element 5.

The pulse detection circuit 7 is a circuit in which the energization start signal Igt1 and the de-energization signal Igt2 are stored.

The ion bias circuit 8 is a bias circuit for making an ion current flow. The ion-current detection circuit 9 supplies the ion-current-output current mirror circuit 10 with an ion current. The ion-current detection circuit 9 is activated at the timing when an ion current flows, and then the ion-current-output current mirror circuit 10 is activated. The ion-current-output current mirror circuit 10 extracts an electric current equivalent to the ion current from the ECU 200. In addition, the input voltage Igt of the coil driver 400 at this timing is given by the following equation:

$$Igt \approx \text{the voltage of the internal power source of the ECU 200} - (\text{ION} \times \text{the resistance value of a resistor 203})$$

As a result, the ion-signal detection/control circuit 300 is activated, and the ion current is transferred to the ion-signal detection/control circuit 300.

By performing an analysis based on the ion current, the in-cylinder combustion condition is ascertained.

Next, the internal combustion engine ignition device according to Embodiment 1 will be described more specifically, with reference to FIG. 2. The reference characters the same as those in FIG. 1 denote the same or equivalent constituent elements.

As illustrated in FIG. 2, the internal combustion engine ignition device according to Embodiment 1 includes the ECU 200, the ignition coil 1, the pulse detection circuit 7, the switching element 5, the ion bias circuit 8, the ion-current detection circuit 9, and the ion-current-output current mirror circuit 10. The ignition coil 1 having the primary coil 2 and the secondary coil 3 is connected to a power-source terminal VB. The ignition plug 4 is connected to the high-voltage side of the secondary coil 3. The ECU 200 has the pulse generation circuit 201 and the ion-signal detection/control circuit 300; the pulse generation circuit 201 supplies to an input terminal 400a of the coil driver 400 the energization start signal Igt1 and the de-energization signal Igt2 that are a single pulse having an extremely short duration or a plurality of pulses, by way of the NPN transistor 202 and the resistor 204. In addition, the pulse generation circuit 201 supplies the energization start signal Igt1 and the de-energization signal Igt2 also to the gate of a P-channel MOSFET 302, described later, in the ion-signal detection/control circuit 300.

At the timing when neither the energization start signal Igt1 nor the de-energization signal Igt2 is supplied to the NPN transistor 202 and the P-channel MOSFET 302, the input voltage Igt of the coil driver 400 is set to a high level (from 5 V to 14 V), and at the timing when the pulse generation circuit 201 supplies the energization start signal Igt1 or the de-energization signal Igt2 to the NPN transistor 202 and the P-channel MOSFET 302, the NPN transistor 202 turns on and the P-channel MOSFET 302 turns off, thereby lowering for an extremely short time the input voltage Igt of the coil driver 400 from the high level (from 5 V to 14 V) to a low level (0 V), so that a signal is supplied to the pulse detection circuit 7.

The pulse detection circuit 7 is a circuit in which the energization start signal Igt1 and the de-energization signal Igt2 are stored; the pulse detection circuit 7 recognizes the signal received from the pulse generation circuit 201 as the energization start signal Igt1 or the de-energization signal Igt2 and supplies an ignition signal to the switching element 5 in the later stage, thereby driving the switching element 5.

The switching element 5 is, for example, an IGBT (insulated gate bipolar transistor (IGBT); the gate terminal is connected to the pulse detection circuit 7, the collector terminal is connected to the primary coil 2 of the ignition coil 1, and the emitter terminal is connected to the reference potential point GND. The ion bias circuit 8 is connected to the low-voltage side of the secondary coil 3.

The ion bias circuit 8 is configured in such a way as to have an output terminal 8*a* and an input terminal 8*b*. The output terminal 8*a* is connected to the ion-current detection circuit 9 in the later stage, and the input terminal 8*b* is connected to the low-voltage side of the secondary coil 3.

The ion-current detection circuit 9 is connected to the ion-current-output current mirror circuit 10 and the ion bias circuit 8.

The ion-current-output current mirror circuit 10 is configured in such a way as to have an output terminal 10*a* and an input terminal 10*b*. The output terminal 10*a* is connected to the input impedance 6 and the pulse detection circuit 7, and the input terminal 10*b* is connected to the ion-current detection circuit 9.

Next, the inner configuration of the ion-signal detection/control circuit 300 will be explained. The ion-signal detection/control circuit 300 is configured with an internal power source 301, the P-channel MOSFET 302, a current mirror circuit 305 including PNP transistors 303 and 304, ion-current detection resistor 306, and an ion-signal control circuit 309. The gate of the P-channel MOSFET 302 in the ion-signal detection/control circuit 300 is connected to the pulse generation circuit 201; the drain is connected to the emitters of the PNP transistors 303 and 304; the source is connected to the internal power source 301. The internal power source 301 is a stabilized power source. The base of the PNP transistor 303 is connected to the base of the PNP transistor 304, and the collector of the PNP transistor 303 is connected to the ion-current detection resistor 306 and the ion-signal control circuit 309. The base of the PNP transistor 304 is connected to the collector of the PNP transistor 304 and the resistor 203. The other terminal of the ion-current detection resistor 306 is connected to the ground GND.

Figure 3:
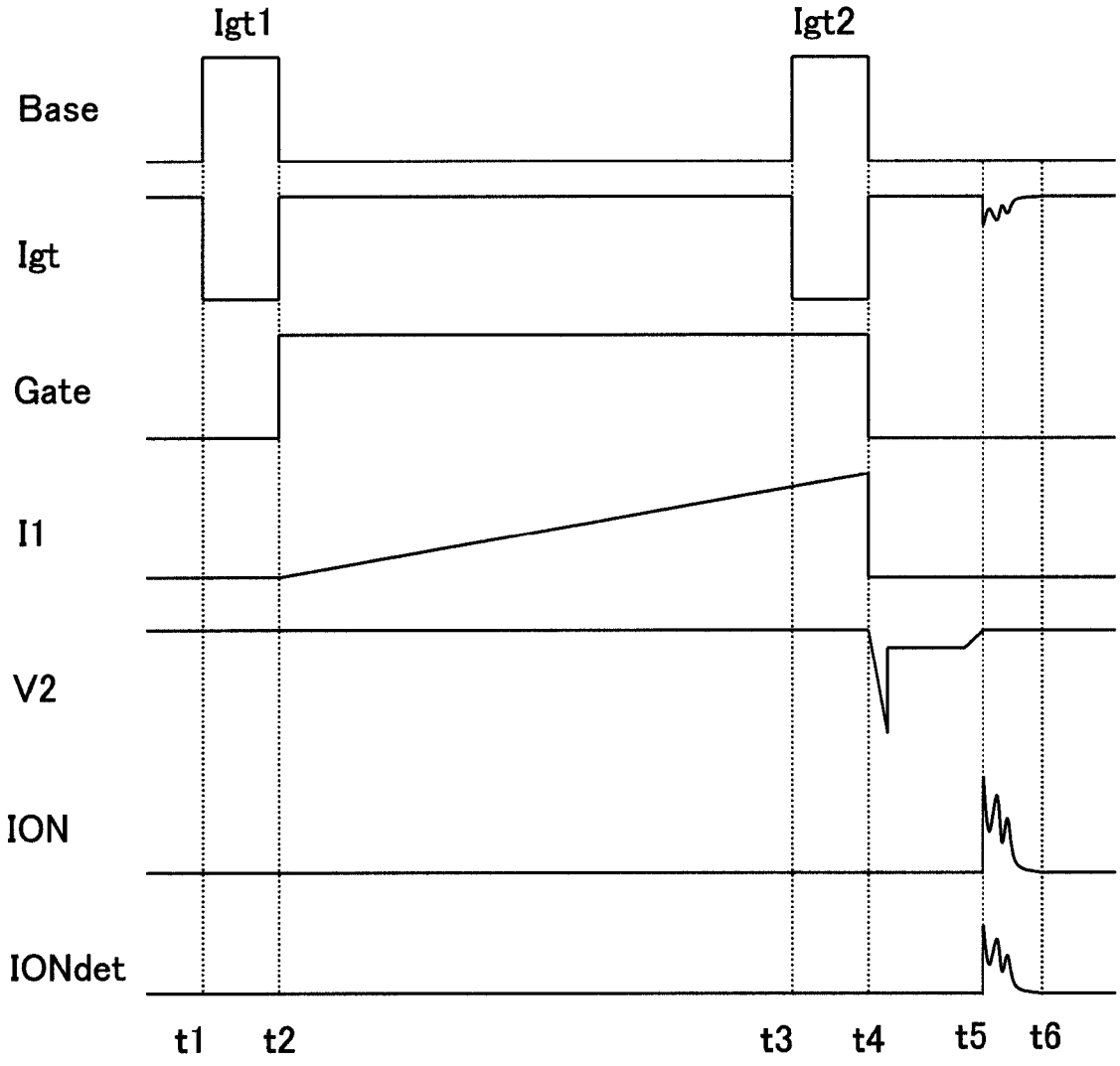
FIG. 3 is an example of timing chart representing waveforms at various operational points in Embodiment 1 of the present invention.

FIG. 3 is a timing chart representing waveforms at various points in Embodiment 1; the operation of the internal combustion engine ignition device illustrated in FIG. 2 will be explained with reference to the timing chart. During the time period between the time points t1 and t2, the pulse generation circuit 201 supplies the NPN transistor 202 and the P-channel MOSFET 302 with the energization start signal Igt1 (here, represented as a single pulse) having an extremely short duration. At the timing when neither the energization start signal Igt1 nor the de-energization signal Igt2 is supplied to the NPN transistor 202 and the P-channel MOSFET 302, the input voltage Igt of the coil driver 400 is set to a high level (from 5 V to 14 V), and at the timing when the pulse generation circuit 201 supplies the energization start signal Igt1 or the de-energization signal Igt2 to the NPN transistor 202 and the P-channel MOSFET 302, the NPN transistor 202 turns on and the P-channel MOSFET 302 turns off, thereby lowering for an extremely short time the input voltage Igt of the coil driver 400 from the high level (from 5 V to 14 V) to a low level (0 V), so that a pulse signal is supplied to the pulse detection circuit 7. The pulse detection circuit 7 recognizes the pulse signal supplied from the pulse generation circuit 201 as the energization start signal Igt1 and, at the time point t2, supplies an ignition signal to the input terminal (the gate, in this case) of the switching element 5 in the later stage, so that the switching element 5 turns on, whereupon the primary-coil current I1 starts to flow through the primary coil 2 of the ignition coil 1.

After that, during the time period between the time points t3 and t4, the pulse generation circuit 201 supplies the NPN transistor 202 and the P-channel MOSFET 302 with the de-energization signal Igt2 (here, represented as a single pulse) having an extremely short duration. The pulse detection circuit 7 recognizes the pulse signal received from the pulse generation circuit 201 as the de-energization signal Igt2 and, at the time point t4, interrupts the ignition signal that has been supplied to the switching element 5 in the later stage. At the time point t4 when, due to the interruption of the voltage supply to the input terminal (here, the gate) of the switching element 5, the switching element 5 turns off, the primary-coil current I1 flowing in the primary coil 2 is interrupted, whereby a high voltage is generated at the collector (here, represented as C) of the switching element 5.

The energy is converted through the secondary coil 3, whereby a negative voltage is induced at the high-voltage side of the secondary coil 3. On that occasion, a high voltage is applied to the low-voltage side of the secondary coil and a voltage is applied across a Zener diode 83 through a diode 81, whereby a capacitor 84 is charged. In the case where the negative voltage, which is large enough to break the insulation in the gap of the ignition plug 4, is generated, a discharge takes place, and, after the time point t4, a secondary-coil current flows from the ignition plug 4 to the ground GND by way of the secondary coil 3, the diode 81, and the Zener diode 83.

At the time instant t5 when the discharge is completed, the voltage charged across the capacitor 84 causes an ion current to start to flow through the secondary coil 3 by the intermediary of a resistor 82. The ion-current detection circuit 9 is activated at this time instant, and then the ion-current-output current mirror circuit 10 is activated. An N-channel MOSFET 101 in the ion-current-output current mirror circuit 10 extracts a drain current, corresponding to the ion current that flows through an N-channel MOSFET 102, from the current mirror circuit 305 in the ion-signal detection/control circuit 300.

As a result, the current mirror circuit 305 in the ion-signal detection/control circuit 300 is activated, and the collector current, corresponding to the ion current that flows through the PNP transistor 304, flows through the PNP transistor 303 in the current mirror circuit 305. The outputted current is converted into a voltage by the ion-current detection resistor 306 and transferred, as an analogue signal, to the ion-signal control circuit 309.

Figure 4:
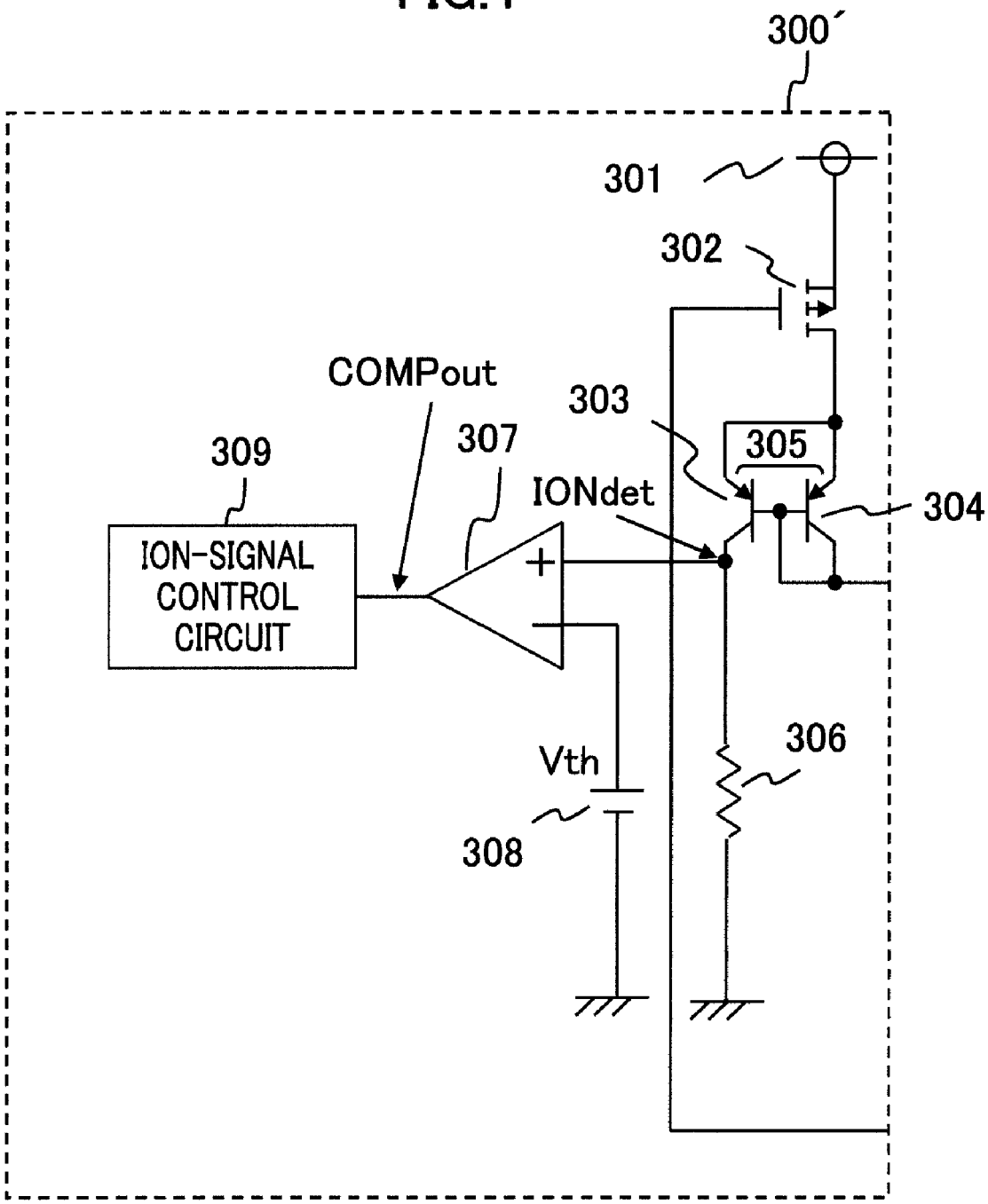
FIG. 4 is a circuit diagram illustrating a variant example of Embodiment 1 of the present invention, in the case where an ion-signal detection/control circuit is digitized.

In addition, in the foregoing internal combustion engine ignition device according to Embodiment 1, by replacing the ion-signal detection/control circuit 300 by an ion-signal detection/control circuit (digital-type) 300' illustrated in FIG. 4, the detection and control of an ion current can digitally be performed.

The digital-type ion-signal detection/control circuit 300' will be explained.

In FIG. 4, the ion-signal detection/control circuit (digital-type) 300' is configured with the internal power source 301, the P-channel MOSFET 302, the current mirror circuit 305 including the PNP transistors 303 and 304, the ion-current detection resistor 306, a comparator circuit 307, a reference voltage 308, and the ion-signal control circuit 309. The gate of the P-channel MOSFET 302 is connected to an unillustrated pulse generation circuit 201; the drain is connected to the emitters of the PNP transistors 303 and 304; the source is connected to the internal power source 301. The internal power source 301 is a stabilized power source. The base of the PNP transistor 303 is connected to the base of the PNP transistor 304, and the collector of the PNP transistor 303 is connected to the ion-current detection resistor 306. The base of the PNP transistor 304 is connected to the collector of the PNP transistor 304 and the resistor 203. The other terminal of the ion-current detection resistor 306 is connected to the ground GND. The input terminal (+) of the comparator circuit 307 is connected to the ion-current detection resistor 306; the input terminal (−) is connected to the reference voltage (Vth) 308; the output terminal of the comparator circuit 307 is connected to the ion-signal control circuit 309.

Figure 5:
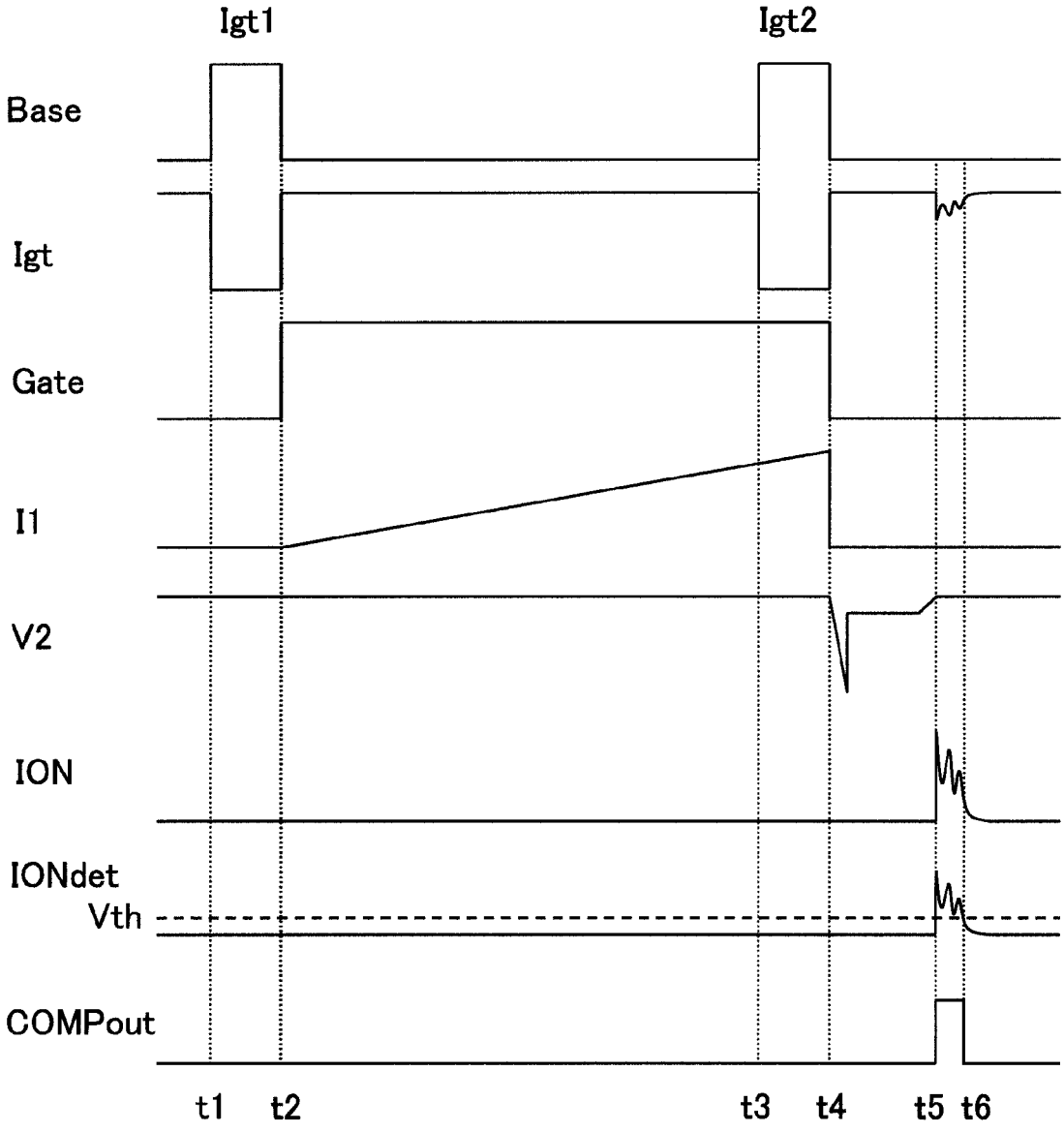
FIG. 5 is an example of timing chart representing waveforms at various operational points in Embodiment 1, in the case where an ion-signal detection/control circuit is digitized.

FIG. 5 is a timing chart representing waveforms at various points in the case where the ion-signal detection/control circuit 300 is replaced by the digital-type ion-signal detection/control circuit 300'. During the time period between the time points t5 and t6, in which the analogue signal obtained by converting an ion current into a voltage by the ion-current detection resistor 306 exceeds the reference voltage (Vth) 308, the comparator circuit 307 outputs a pulse as a digital signal to the ion-signal control circuit 309. In addition, the operation up to the time point when the ion current is supplied to the ion-current detection resistor 306 is the same as that represented in FIG. 3; therefore, the explanation therefor will be omitted.

Figure 6:
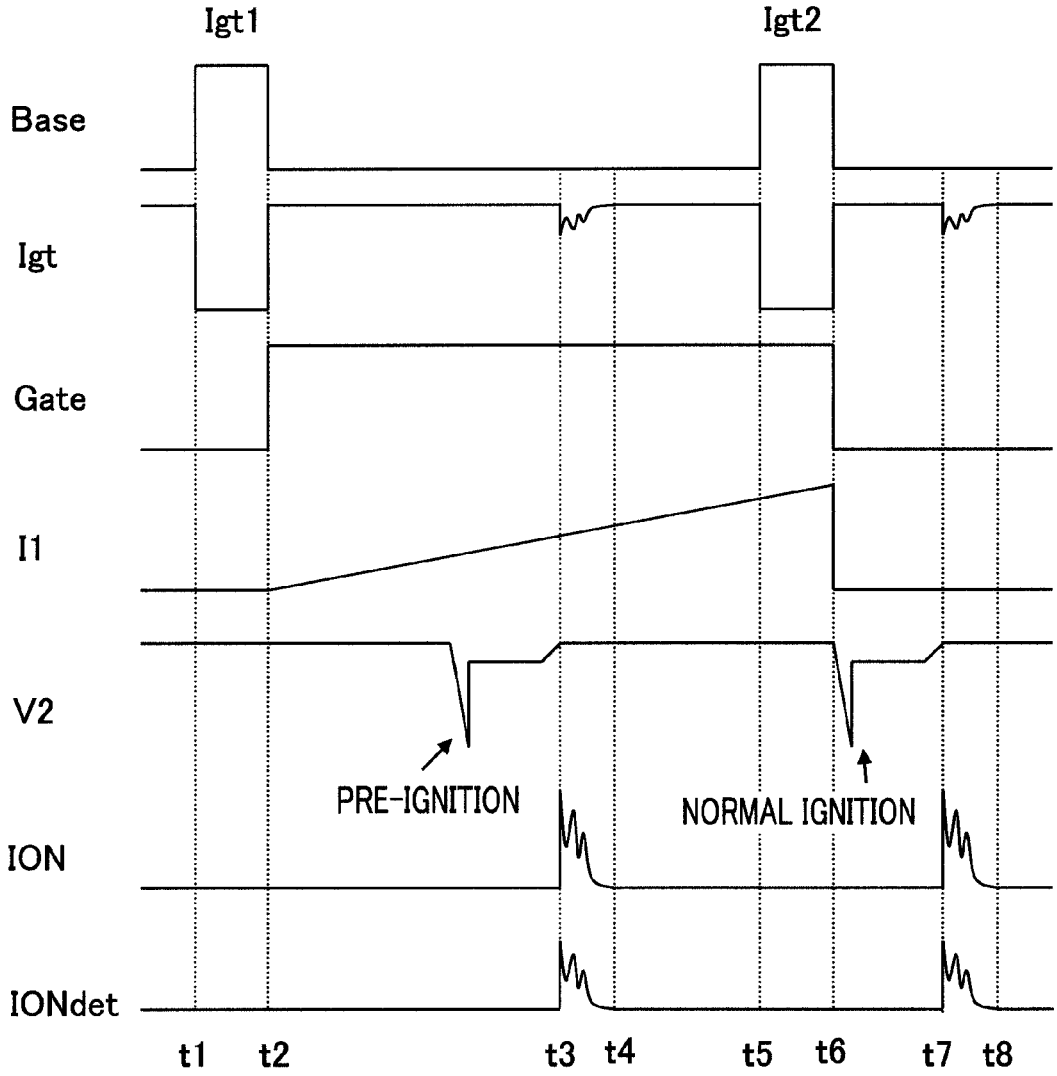
FIG. 6 is another example of timing chart representing waveforms at various operational points in Embodiment 1 of the present invention.

In the internal combustion engine ignition device, according to Embodiment 1 of the present invention, configured as described above, even in the case where, as represented by a timing chart in FIG. 6, the inside of the engine compartment becomes high-temperature, whereby pre-ignition causes an ion current to occur during the time period between the time points t3 and t4, which is earlier than the normal timing, the ion-current-output current mirror circuit 10 can be activated by setting the input voltage Igt of the coil driver 400 to a high level (from 5 V to 14 V) at the timing except the timing when the pulse generation circuit 201 supplies the energization start signal Igt1 or the de-energization signal Igt2 to the NPN transistor 202 and the P-channel MOSFET 302. As a result, even during the time period in which the primary-coil current I1 flows, the outputted ion current can be transferred to the ion-signal control circuit 309, whereby it is made possible to enlarge the region in which the ion current can be detected.

Figure 7:
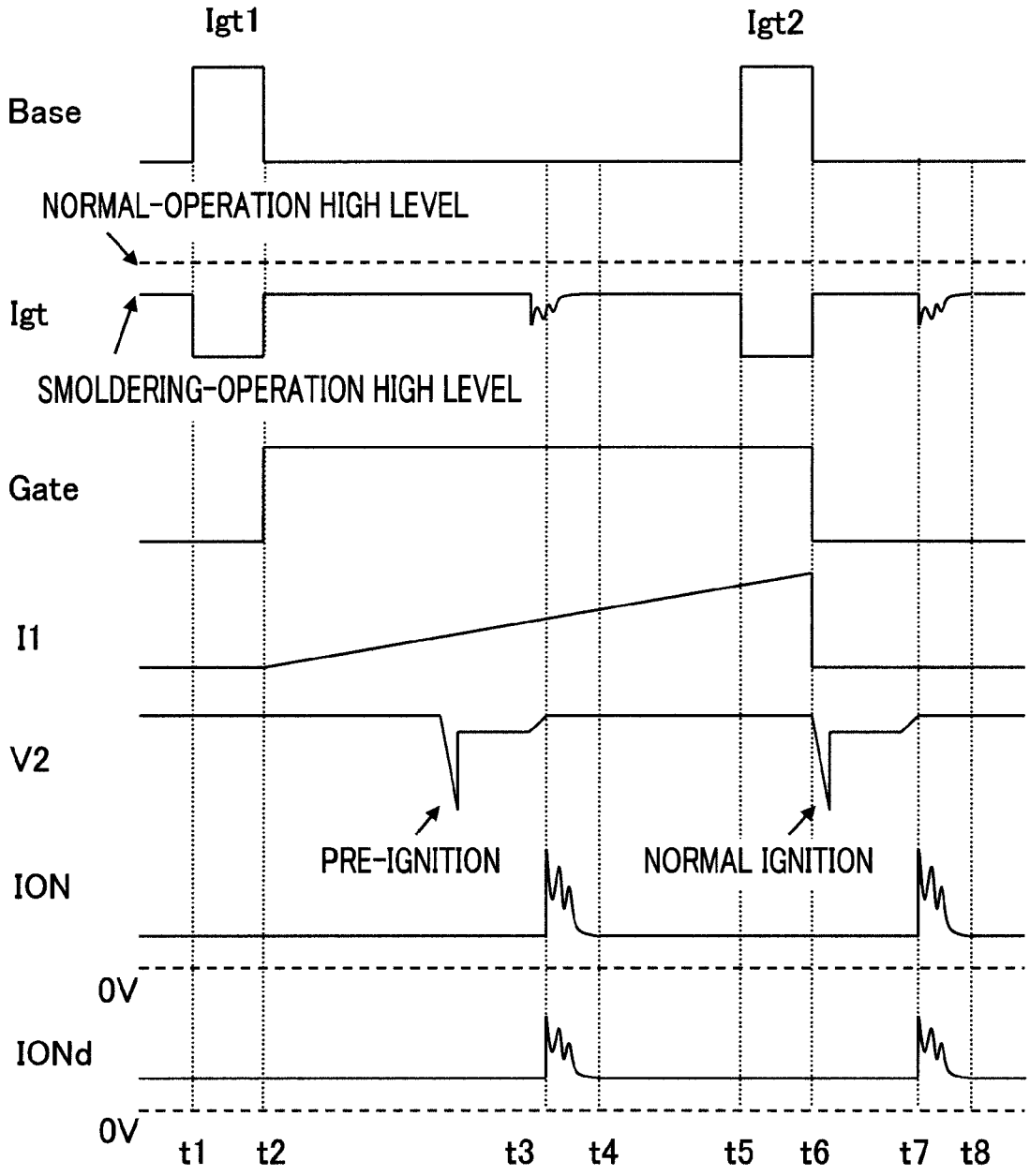
FIG. 7 is another example of timing chart representing waveforms at various operational points in Embodiment 1 of the present invention.

Moreover, even in the case where, as represented by a timing chart in FIG. 7, a smolder around the ignition plug causes soot or the like to be produced in the space between the electrodes and a leakage electric current to flow, whereby a pseudo ion current always flows, and even in the case where the inside of the engine compartment becomes high-temperature, whereby pre-ignition causes an ion current to occur at the timing which is earlier than the normal timing, an ion current can accurately be detected by a 5-volt system, without expanding the dynamic range of the input voltage Igt, although the high level of the input voltage Igt is lowered.

Embodiment 2

Figure 8A:
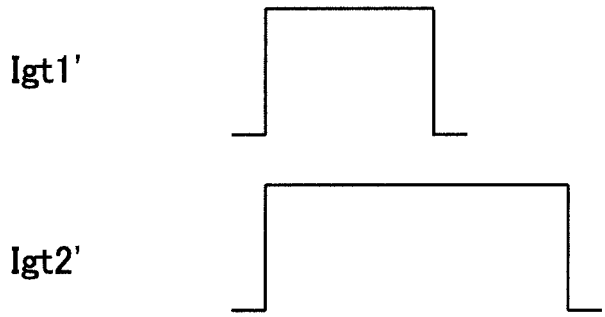
FIG. 8 is a set of charts each representing the waveform of a pulse signal according to Embodiment 2 of the present invention.
Figure 8B:
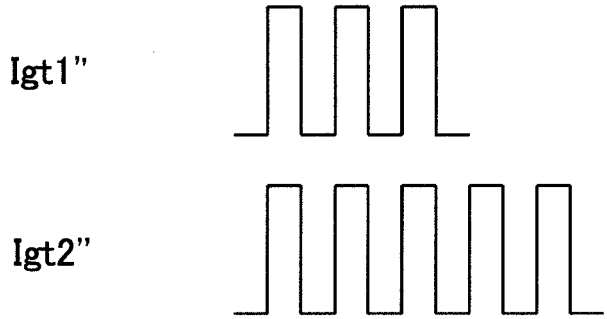

An internal combustion engine ignition device according to Embodiment 2 of the present invention is configured in such a way that, in the foregoing Embodiment 1, as an example represented in FIG. 8, the pulse generation circuit 201 outputs an energization start signal Igt1' and a de-energization signal Igt2' that are different from each other in pulse width (refer to FIG. 8A), or the pulse generation circuit 201 outputs an energization start signal Igt1" and a de-energization signal Igt2" that are different from each other in the number of pulses (refer to FIG. 8B).

According to Embodiment 2, the pulse detection circuit 7 can readily distinguish between the energization start signal Igt1' and the de-energization signal Igt2' that are outputted from the pulse generation circuit 201.

Embodiment 3

An internal combustion engine ignition device according to Embodiment 3 of the present invention is configured in such a way that, in the foregoing Embodiment 1, the value of the input impedance 6 in the coil driver 400 is set to be extremely large compared with the value of the resistor 204 in the ECU 200.

According to Embodiment 3, even in the case where, while the pulse generation circuit generates the energization start signal Igt1 or the de-energization signal Igt2, an ion current flows, no electric current flows in the ion-current-output current mirror circuit 10; therefore, the pulse generation circuit 201 can stably supply the energization start signal Igt1 and the de-energization signal Igt2, and the ion detection can stably be performed without affecting the ignition signal.

Embodiment 4

Figure 9:
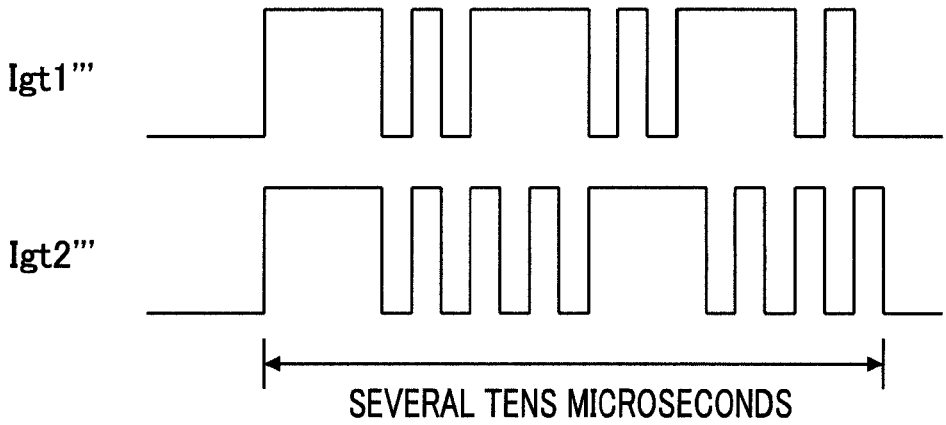
FIG. 9 is a set of charts each representing the waveform of a pulse signal according to Embodiment 4 of the present invention.

An internal combustion engine ignition device according to Embodiment 4 of the present invention is configured in such a way that, in the foregoing Embodiment 1, as an example represented in FIG. 9, the pulse generation circuit 201 outputs an energization start signal Igt1''' and a de-energization signal Igt2''' that are signals each including at least two kinds of pulse widths (for example, a combination signal, having a width of several tens microseconds, consisting of a low-frequency pulse signal and a high-frequency pulse signal), and provision is made for the pulse detection circuit 7 that detects the fact that the pulse signals are inputted in predetermined order.

According to Embodiment 4, even in the case where noise such as a surge voltage intrudes in the input signal line of the coil driver 400, the noise is not recognized as the energization start signal or the de-energization signal because high-frequency noise and low-frequency noise each include continuous noise signals that are of the same frequency; therefore, problems such as re-energization of the primary coil and erroneous ignition can be avoided.

Embodiment 5

An internal combustion engine ignition device according to Embodiment 5 is configured in such a way that, in the foregoing Embodiment 1, provision is made, in the coil driver 400, for a response circuit that transmits a signal that indicates the start of energization, in a constant time after detecting the fact that the pulse generation circuit 201 has supplied the energization start signal Igt1 to the pulse detection circuit 7, and provision is made, in the ECU 200, for a response monitoring circuit that detects the signal transmitted by the response circuit.

Figure 10:
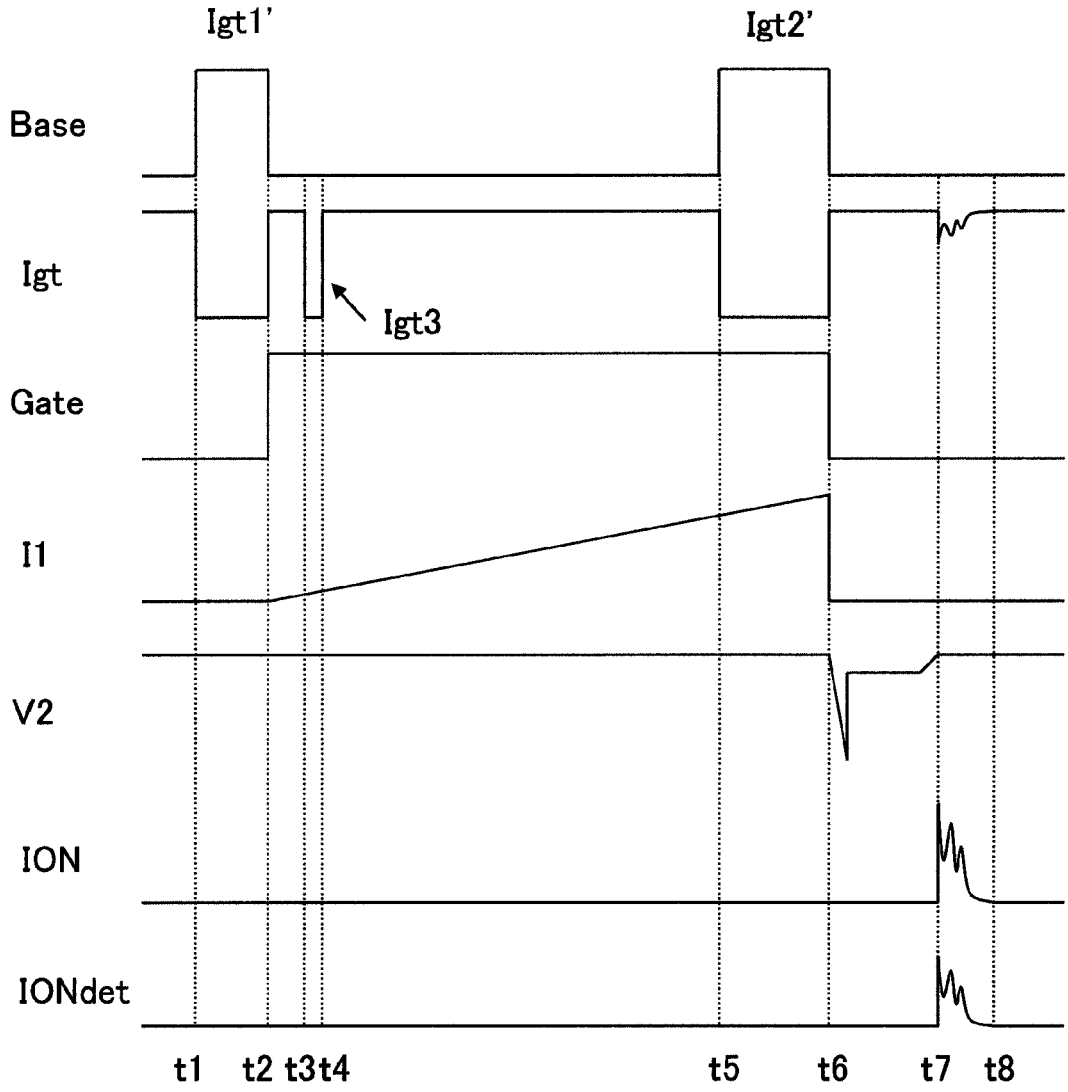
FIG. 10 is an example of timing chart representing waveforms at various operational points in Embodiment 5 of the present invention.

FIG. 10 is a timing chart representing waveforms at various points in Embodiment 5.

According to Embodiment 5, during the time period between the time points t1 and t2 in the timing chart in FIG. 10, the pulse detection circuit 7 detects the energization start signal Igt1', and the response circuit transmits a response signal Igt3 to the Igt1 line. The response monitoring circuit detects the response signal Igt3, and the operation status detected by the response monitoring circuit and the operation status indicated by the ECU 200 are compared, so that it can be determined whether or not the coil driver operates normally.

Embodiment 6

An internal combustion engine ignition device according to Embodiment 6 of the present invention is configured in such a way that, in the foregoing Embodiment 5, provision is made, in the ECU 200, for a function for recurrently transmitting the same signal in the case where the operation status detected by the response monitoring circuit is different from a predetermined operation status.

Figure 11:
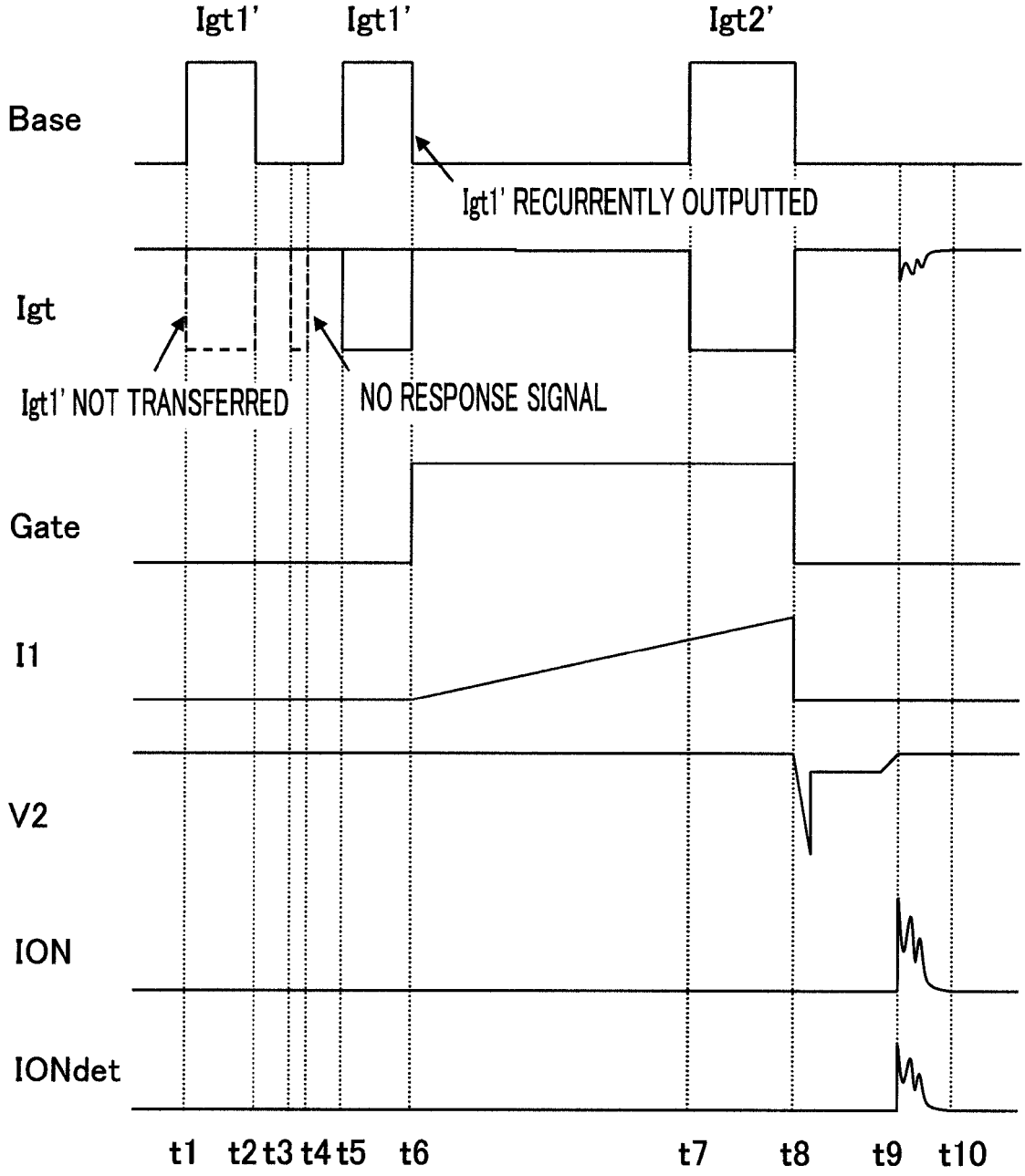
FIG. 11 is an example of timing chart representing waveforms at various operational points in Embodiment 6 of the present invention.

FIG. 11 is a timing chart representing waveforms at various points in Embodiment 6.

According to Embodiment 6, even in the case where, during the time period between the time points t1 and t2 in the timing chart represented in FIG. 11, a normal signal transfer from the pulse generation circuit 201 to the pulse detection circuit 7 cannot be performed, the response circuit does not transmit the response signal Igt3 to the Igt1 line; thus, by making the response monitoring circuit in the ECU 200 detect the foregoing fact that a normal signal transfer cannot be performed and supply, during the recurrent time period between the time points t5 and t6, the energization start signal Igt1' to the pulse detection circuit 207, the operational accuracy of the coil driver can be enhanced.

Embodiment 7

Figure 12:
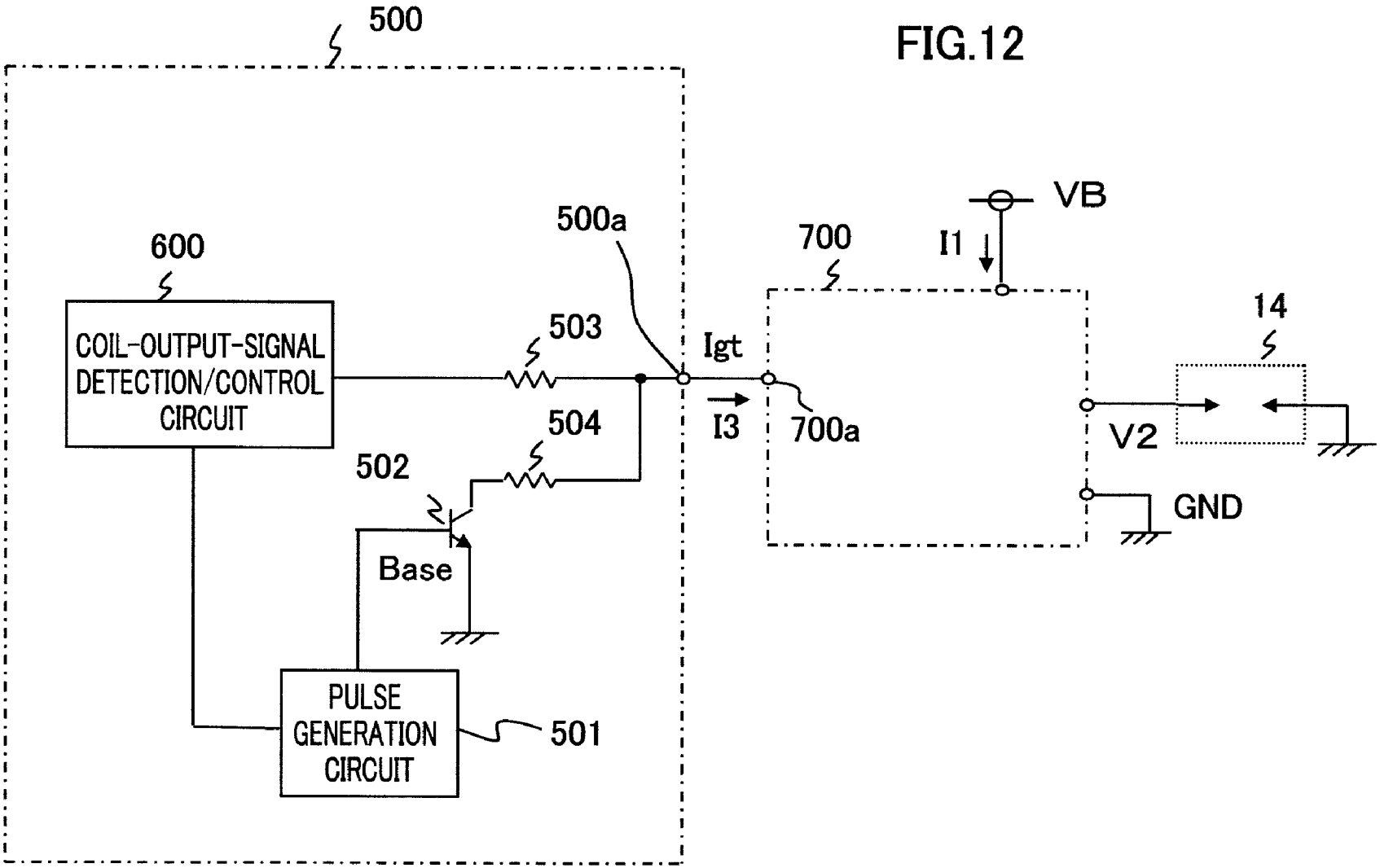
FIG. 12 is a schematic block diagram illustrating principal parts of an internal combustion engine ignition device according to Embodiment 7 of the present invention.
Figure 13:
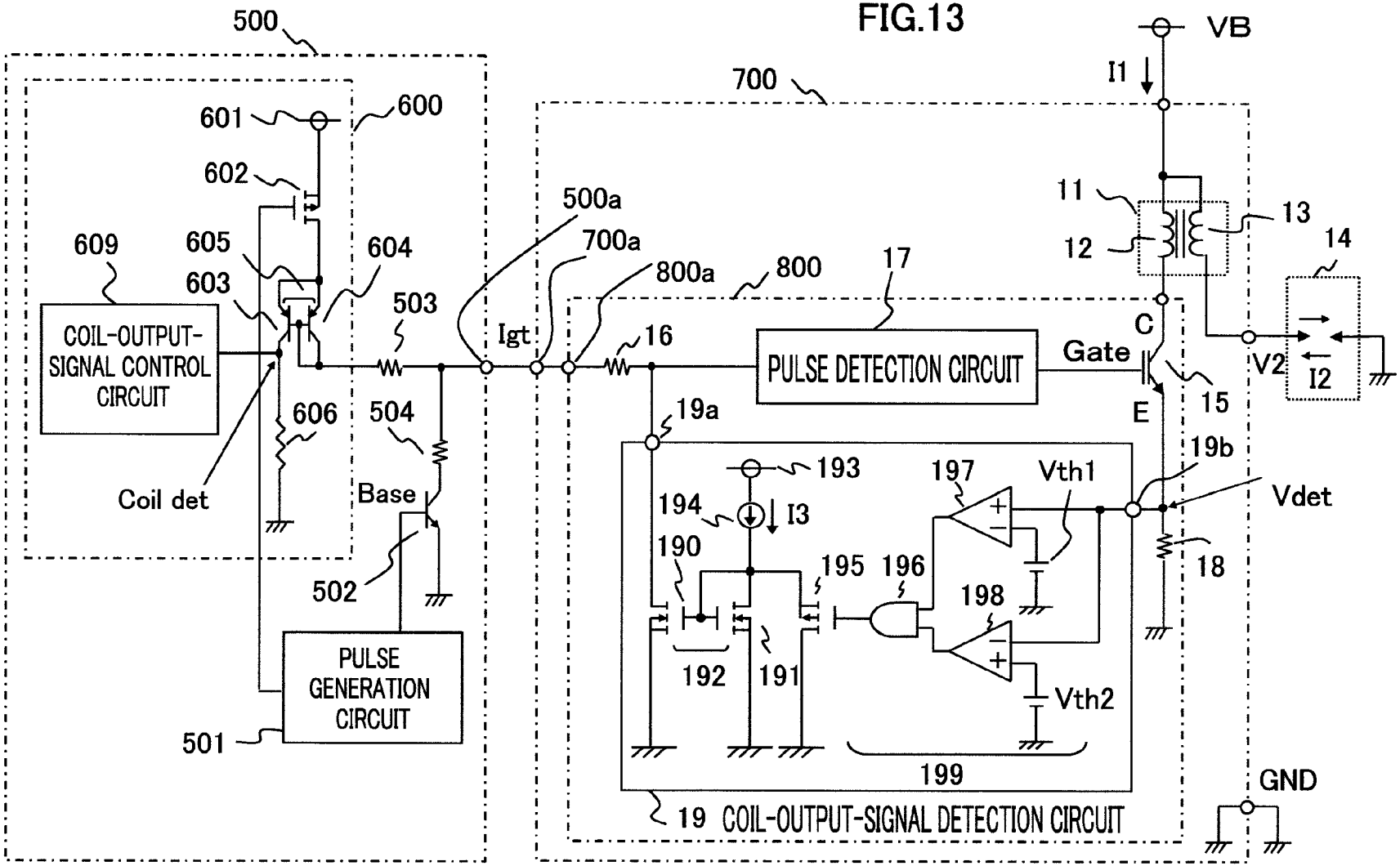
FIG. 13 is a detailed circuit diagram of an internal combustion engine ignition device according to Embodiment 7 of the present invention.

FIGS. 12 and 13 are circuit block diagrams illustrating an internal combustion engine ignition device according to Embodiment 7 of the present invention; FIG. 12 is a schematic block diagram illustrating principal parts of Embodiment 7; FIG. 13 is a detailed circuit diagram for the principal parts illustrated in FIG. 12. In the first place, the principal parts of Embodiment 7 of the present invention will be explained with reference to FIG. 12.

As illustrated in FIG. 12, the internal combustion engine ignition device according to Embodiment 7 of the present invention is provided with a coil 700 including a coil driver, a pulse generation circuit 501 that is incorporated in an ECU 500 and outputs an energization start signal Igt1 and a de-energization signal Igt2, an NPN transistor 502 that supplies a signal to the coil 700 including a coil driver, based on the energization start signal Igt1 and the de-energization signal Igt2 that are outputted by the pulse generation circuit 501, and a coil-output-signal detection/control circuit 600 that detects and controls the output signal of the coil 700 including a coil driver. In the coil 700 including a coil driver, the energization start signal Igt1 and the de-energization signal Igt2 are stored; a signal, supplied from the collector of the NPN transistor 502 by way of a resistor 504, is recognized as the energization start signal Igt1 or the de-energization signal Igt2; an ignition signal is supplied to a switching element, thereby flowing and interrupting a primary-coil current I1 for the primary coil of an ignition coil so as to generate a high voltage for igniting the ignition plug 14; and a signal, outputted when the coil 700 including a coil driver is activated, is detected and outputted to the ECU 500.

At the timing when the pulse generation circuit 501 outputs neither the energization start signal Igt1 nor the de-energization signal Igt2, the input voltage Igt of the coil 700 including a coil driver is set to a high level (from 5 V to 14 V), and at the timing when the pulse generation circuit 501 outputs the energization start signal Igt1 or the de-energization signal Igt2, the input voltage Igt of the coil 700 including a coil driver is lowered for an extremely short time from the high level (from 5 V to 14 V) to a low level (0 V), so that the coil 700 including a coil driver recognizes the change in the input voltage Igt as the energization start signal Igt1 or the de-energization signal Igt2 and flows and interrupts the primary-coil current I1 so as to generate a high voltage for igniting the ignition plug 14.

The coil 700 including a coil driver detects a signal outputted through a series of operations thereof and extracts a constant current I3 from the ECU 500.

In addition, the input voltage Igt of the coil 700 including a coil driver at this timing is given by the following equation:

*Igt*≈the voltage of the internal power source of the ECU 500−(the constant current *I3*×the resistance value of a resistor 503)

As a result, a coil-output-signal detection/control circuit 600 is activated, and a coil output signal is transferred to the coil-output-signal detection/control circuit 600.

By performing an analysis based on the coil output signal, a malfunction of the coil 700 including a coil driver is detected.

Next, the internal combustion engine ignition device according to Embodiment 7, in the case where the primary-coil current I1 is utilized as the signal that is detected by the coil 700 including a coil driver, will be described specifically, with reference to FIG. 13. As illustrated in FIG. 13, the internal combustion engine ignition device according to Embodiment 7 includes the ECU 500, an ignition coil 11, a pulse detection circuit 17, a switching element 15, and a coil-output-signal detection circuit 19. The ignition coil 11 having a primary coil 12 and a secondary coil 13 is connected to a power-source terminal VB. The ignition plug 14 is connected to the high-voltage side of the secondary coil 13. The ECU 500 has the pulse generation circuit 501 and the coil-output-signal detection/control circuit 600; by way of the NPN transistor 502 and the resistor 504, the pulse generation circuit 501 supplies to an input terminal 800*a* of a coil driver 800 the energization start signal Igt1 and the de-energization signal Igt2 that each are a single pulse having an extremely short duration or a plurality of pulses. At the timing when neither the energization start signal Igt1 nor the de-energization signal Igt2 is supplied to the NPN transistor 502 and a P-channel MOSFET 602, the input voltage Igt of the coil driver 800 is set to a high level (from 5 V to 14 V), and at the timing when the pulse generation circuit 501 supplies the energization start signal Igt1 or the de-energization signal Igt2 to the NPN transistor 502 and the P-channel MOSFET 602, the NPN transistor 502 turns on and the P-channel MOSFET 302 turns off, thereby lowering for an extremely short time the input voltage Igt of the coil driver 800 from the high level (from 5 V to 14 V) to a low level (0 V), so that a signal is supplied to the pulse detection circuit 17.

The pulse detection circuit 17 is a circuit in which the energization start signal Igt1 and the de-energization signal Igt2 are stored; the pulse detection circuit 17 recognizes the signal received from the pulse generation circuit 501 as the energization start signal Igt1 or the de-energization signal Igt2 and supplies an ignition signal to the switching element 15 in the later stage, thereby driving the switching element 15. The switching element 15 is, for example, an IGBT (insulated gate bipolar transistor (IGBT); the gate terminal is connected to the pulse detection circuit 17, the collector terminal is connected to the primary coil 12 of the ignition coil 11, and the emitter terminal is connected to a detection resistor 18 and the coil-output-signal detection circuit 19. The other terminal of the detection resistor 18 is connected to the reference potential point GND.

The coil-output-signal detection circuit 19 is configured in such a way as to have an output terminal 19*a* and an input terminal 19*b*. The output terminal 19*a* is connected to an input impedance 16 and the pulse detection circuit 17, and the input terminal 19*b* is connected to the emitter terminal of the switching element 15 and the detection resistor 18. The coil-output-signal detection circuit 19 is configured with a current mirror circuit 192 including N-channel MOSFETs 190 and 191, an internal power source 193, a current source 194, a P-channel MOSFET 195, an AND circuit 196, and a window comparator circuit 199 including comparator circuits 197 and 198.

The gate of the N-channel MOSFET 190 is connected to the gate of the N-channel MOSFET 191; the drain is connected to the output terminal 19*a;* the source is connected to the ground GND. The gate of the N-channel MOSFET 191 is connected to the drain of the N-channel MOSFET 191, the current source 194, and the source of the P-channel MOSFET 195. The other terminal of the current source 194 is connected to the internal power source 193. The internal power source 193 is a stabilized power source. The gate of the P-channel MOSFET 195 is connected to the output terminal of the AND circuit 196, and the drain is connected to the ground GND. One input terminal of the AND circuit 196 is connected to the output terminal of the comparator circuit 197; the other input terminal is connected to the output terminal of the comparator circuit 198. The input terminal (+) of the comparator circuit 197 is connected to the input terminal 19*b;* the input terminal (−) is connected to a reference voltage (Vth1). The input terminal (+) of the comparator circuit 198 is connected to a reference voltage (Vth2); the input terminal (−) is connected to the input terminal 19*b*.

Next, the inner configuration of the coil-output-signal detection/control circuit 600 will be explained. The coil-output-signal detection/control circuit 600 is provided with an internal power source 601, the P-channel MOSFET 602, a current mirror circuit 605 including PNP transistors 603 and 604, a coil-output-signal detection resistor 606, and a coil-output-signal control circuit 609.

The gate of the P-channel MOSFET 602 is connected to the pulse generation circuit 501; the drain is connected to the emitters of the PNP transistors 603 and 604; the source is connected to the internal power source 601. The internal power source 601 is a stabilized power source. The base of the PNP transistor 603 is connected to the base of the PNP transistor 604, and the collector of the PNP transistor 603 is connected to the coil-output-signal detection resistor 606 and the coil-output-signal control circuit 609. The base of the PNP transistor 604 is connected to the collector of the PNP transistor 604 and a resistor 503. The other terminal of the coil-output-signal detection resistor 606 is connected to the ground GND.

Figure 14:
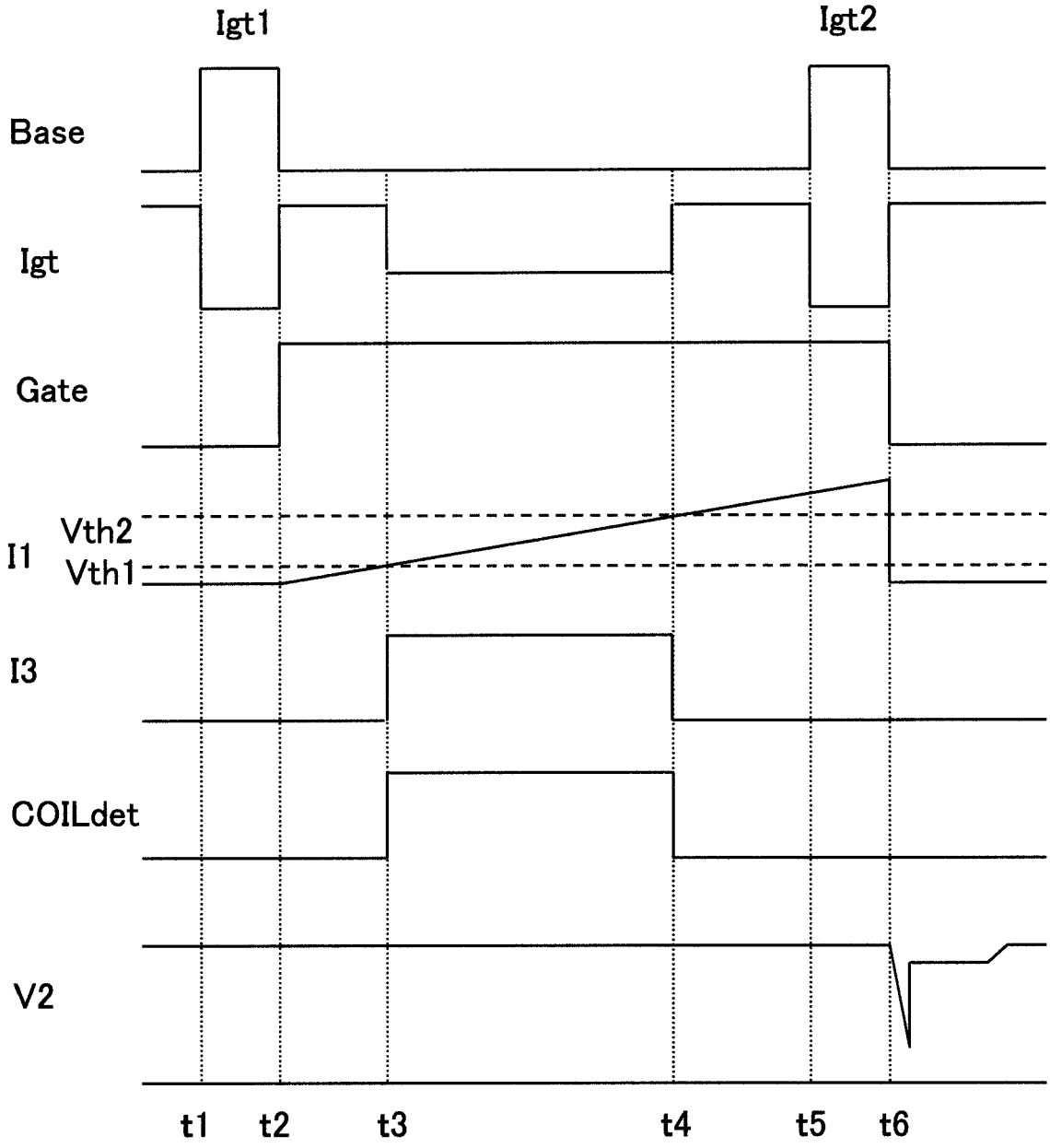
FIG. 14 is a timing chart representing waveforms at various operational points in Embodiment 7 of the present invention.

FIG. 14 is a timing chart representing waveforms at various points in Embodiment 7; the operation of the internal combustion engine ignition device illustrated in FIG. 12 will be explained with reference to the timing chart. During the time period between the time points t1 and t2, the pulse generation circuit 501 supplies the NPN transistor 502 and the P-channel MOSFET 602 with the energization start signal Igt1 (here, represented as a single pulse) having an extremely short duration. At the timing when neither the energization start signal Igt1 nor the de-energization signal Igt2 is supplied to the NPN transistor 502 and the P-channel MOSFET 602, the input voltage Igt of the coil driver 800 is set to a high level (from 5 V to 14 V), and at the timing when the pulse generation circuit 501 supplies the energization start signal Igt1 or the de-energization signal Igt2 to the NPN transistor 502 and the P-channel MOSFET 602, the NPN transistor 502 turns on and the P-channel MOSFET 602 turns off, thereby lowering for an extremely short time the input voltage Igt of the coil driver 800 from the high level (from 5 V to 14 V) to a low level (0 V), so that a pulse signal is supplied to the pulse detection circuit 17. The pulse detection circuit 17 recognizes the pulse signal supplied from the pulse generation circuit 501 as the energization start signal Igt1 and, at the time point t2, supplies an ignition signal to the input terminal (the gate, in this case) of the switching element 15 in the later stage, so that the switching element 15 turns on, whereupon the primary-coil current I1 starts to flow through the primary coil 12 of the ignition coil 11.

After that, at the time point t3 when a voltage Vdet, which is produced when the primary-coil current I1 flows through the detection resistor 18, is between Vth1 and Vth2, the output of the window comparator circuit 199 becomes high-level, whereby the P-channel MOSFET 195 turns off. The constant current I3 is supplied from the current source 194 to the current mirror circuit 192 at this time instant, and then the current mirror circuit 192 is activated. The N-channel MOSFET 190 in the current mirror circuit 192 extracts a drain current, corresponding to the constant current I3 that flows through the N-channel MOSFET 191, from the current mirror circuit 605 in the coil-output-signal detection/control circuit 600.

As a result, the current mirror circuit 605 in the coil-output-signal detection/control circuit 600 is activated, and the collector current, corresponding to the constant current I3 that flows through the PNP transistor 604, flows through the PNP transistor 603 in the current mirror circuit 605. The outputted current is converted into a voltage by the coil-output-signal detection resistor 606 and transferred to the coil-output-signal control circuit 609.

After that, at the time point t4 when the voltage Vdet is larger than Vth2, the output of the window comparator circuit 199 becomes low-level, whereby the P-channel MOSFET 195 turns on. The gate voltages of the N-channel MOSFETs 190 and 191 become low-level at this time instant, and then the operation of the current mirror circuit 192 stops. On that occasion, the current supply to the coil-output-signal detection resistor 606 stops.

As described above, in the internal combustion engine ignition device according to Embodiment 7, in the case where some sort of failure such as breakage of the primary coil 12 is caused in the coil 700 including a coil driver, the ECU 500 can detect the abnormality and can perform a failure diagnosis.

Moreover, by, as the coil output signal to be detected, utilizing a primary-coil voltage, a secondary-coil current, a secondary-coil voltage, or the like, the failure diagnosis on the coil 700 including a coil driver can widely be performed.

In addition, the foregoing Embodiments 2 to 6 are applicable not only to Embodiment 1 but also to Embodiment 7.

Various modifications and alterations of this invention will be apparent to those skilled in the art without departing from the scope and spirit of this invention, and it should be understood that this is not limited to the illustrative embodiments set forth herein.

What is claimed is:

1. An internal combustion engine ignition device including an ignition coil having a primary coil and a secondary coil and a switching element that generates an ignition high voltage across the secondary coil of the ignition coil by flowing and interrupting a primary-coil current of the ignition coil, the internal combustion engine ignition device comprising:

an ECU (electronic control unit) including a pulse generation circuit that supplies a coil-driver input signal line with a single pulse signal having an extremely short duration or a plurality of pulse signals, as an energization start signal Igt1 or a de-energization signal Igt2;

a pulse detection circuit that stores the energization start signal and the de-energization signal, that recognizes the single pulse signal or the plurality of pulse signals, received by way of the coil-driver input signal line from the pulse generation circuit, as the energization start signal or the de-energization signal, and that supplies an ignition signal to the switching element;

an ion bias circuit that is connected to a low-voltage side of the secondary coil and generates an ion current;

an ion-current detection circuit that detects an ion current flowing through the secondary coil;

an ion-current output circuit that outputs an ion signal at the coil-driver input signal line, based on an output signal of the ion-current detection circuit; and an ion-signal detection/control circuit that is included in the ECU and that detects and controls an output signal of the ion-current output circuit, wherein, at a timing when the pulse generation circuit outputs neither the energization start signal nor the de-energization signal, the ion-signal detection/control circuit sets an input voltage Igt of a coil driver to a high level, and at a timing when the pulse generation circuit outputs the energization start signal or the de-energization signal, the input voltage Igt of the coil driver is lowered for an extremely short time from the high level to a low level, so that the pulse detection circuit recognizes the change in the input voltage Igt as the energization start signal or the de-energization signal and supplies an ignition signal to the switching element, and wherein, at a timing except the timing when the energization start signal and the de-energization signal is supplied to the pulse detection circuit, the ion-current output circuit outputs an ion signal at the coil-driver input signal line, based on an ion current detected by the ion-current detection circuit.

2. The internal combustion engine ignition device according to claim 1, wherein the pulse generation circuit supplies the coil driver with an energization start signal and a de-energization signal that are different from each other in pulse width or in the number of pulses.

3. The internal combustion engine ignition device according to claim 1, wherein the value of an input impedance of the coil driver is set to be extremely large in comparison with the resistor value of a supply line in the ECU for the energization start signal and the de-energization signal.

4. The internal combustion engine ignition device according to claim 2, wherein the pulse detection circuit detects that, as the energization start signal or the de-energization signal, a signal having at least two kinds of pulse widths is inputted in predetermined order.

5. The internal combustion engine ignition device according to claim 2, wherein, in the coil driver, provision is made for a response circuit that transmits a signal indicating an energization start to the ECU, in a constant time after the pulse detection circuit detects the energization start signal and the de-energization signal supplied from the pulse generation circuit, and wherein, in the ECU, provision is made for a response monitoring circuit that detects the signal transmitted by the response circuit, and an operation status detected by the response monitoring circuit and an operation status indicated by the ECU are compared, so that it is determined whether or not the coil driver operates normally.

6. The internal combustion engine ignition device according to claim 5, wherein, in the case where an operation status that is detected by the response monitoring circuit in a constant time after the ECU transmits the energization start signal and the de-energization signal is different from a predetermined operation status, the ECU recurrently transmits the same signals, so that the accuracy of the coil driver is enhanced.

7. An internal combustion engine ignition device including an ignition coil having a primary coil and a secondary coil and a switching element that generates an ignition high voltage across the secondary coil of the ignition coil by flowing and interrupting a primary-coil current of the ignition coil, the internal combustion engine ignition device comprising:

an ECU (electronic control unit) including a pulse generation circuit that supplies a coil-driver input signal line with a single pulse signal having an extremely short. duration or a plurality of pulse signals, as an energization start signal Igt1 or a de-energization signal Igt2;

a pulse detection circuit that stores the energization start signal and the de-energization signal, recognizes the single pulse signal or the plurality of pulse signals, received by way of the coil-driver input signal line from the pulse generation circuit, as the energization start signal or the de-energization signal, and supplies an ignition signal to the switching element;

a coil-output-signal detection circuit that detects a signal outputted from the ignition coil and outputs at the coil-driver input signal line an output signal as a failure diagnosis signal, based on the detected signal; and a coil-output-signal detection/control circuit that is included in the ECU and that detects and controls the output signal of the coil-output-signal detection circuit, wherein, at a timing when the pulse generation circuit outputs neither the energization start signal nor the de-energization signal, the coil-output-signal detection/control circuit sets an input voltage Igt of a coil driver to a high level, and at a timing when the pulse generation circuit outputs the energization start signal or the de-energization signal, the input voltage Igt of the coil driver is lowered for an extremely short time from the high level to a low level, so that the pulse detection circuit recognizes the input voltage Igt as the energization start signal or the de-energization signal and supplies an ignition signal to the switching element, and wherein, at a timing except the timing when the energization start signal and the de-energization signal is supplied to the pulse detection circuit, the coil-output-signal detection circuit detects a signal outputted from the ignition coil and outputs at the coil-driver input signal line an output signal as a failure diagnosis signal.

* * * * *